US009574339B2

(12) United States Patent
Browning et al.

(10) Patent No.: US 9,574,339 B2
(45) Date of Patent: Feb. 21, 2017

(54) CONCRETE MASONRY UNIT BLOCKS WITH DIMENSIONAL LUMBER POCKETS AND ASSEMBLIES OF BLOCKS AND LUMBER

(71) Applicant: Oldcastle Architectural, Inc., Atlanta, GA (US)

(72) Inventors: Leonard Browning, Aurora, IL (US); David Ronald Rice, Cumming, GA (US)

(73) Assignee: Oldcastle Architectural, Inc., Atlanta, GA (US)

( * ) Notice: Subject to any disclaimer, the term of this patent is extended or adjusted under 35 U.S.C. 154(b) by 0 days.

(21) Appl. No.: 14/298,599

(22) Filed: Jun. 6, 2014

(65) Prior Publication Data

US 2014/0366471 A1 Dec. 18, 2014

Related U.S. Application Data

(60) Provisional application No. 61/832,360, filed on Jun. 7, 2013.

(51) Int. Cl.

| | |
|---|---|
| ***E04B 1/02*** | (2006.01) |
| ***E04B 1/10*** | (2006.01) |
| ***E04C 1/00*** | (2006.01) |
| ***E04B 1/04*** | (2006.01) |
| ***E04B 1/38*** | (2006.01) |
| ***E04C 3/12*** | (2006.01) |
| ***E04C 3/20*** | (2006.01) |
| ***E04H 17/14*** | (2006.01) |
| ***E04B 5/12*** | (2006.01) |
| ***E04B 2/28*** | (2006.01) |
| ***E04C 1/39*** | (2006.01) |
| *E04C 3/02* | (2006.01) |

(52) U.S. Cl.

CPC ..... *E04B 1/043* (2013.01); *E04B 1/38* (2013.01); *E04B 2/28* (2013.01); *E04B 5/12* (2013.01); *E04C 1/00* (2013.01); *E04C 1/39* (2013.01); *E04C 3/12* (2013.01); *E04C 3/20* (2013.01); *E04H 17/143* (2013.01); *E04C 2003/023* (2013.01); *E04H 2017/1465* (2013.01)

(58) Field of Classification Search

CPC ..... E04B 1/02; E04B 1/04; E04B 1/043; E04B 1/10; E04B 1/14; E04B 1/38; E04B 5/12; E04B 2/28; E04C 1/40; E04C 1/38; E04C 3/12; E04C 3/20; E04C 1/00; E04C 1/39; E04C 2003/023; E04H 17/143; E04H 2017/1465

USPC ..... 52/33, 27, 169.9, 233, 252, 251, 259,52/245, 249

See application file for complete search history.

(56) References Cited

U.S. PATENT DOCUMENTS 2,184,682 A * 12/1939 Sentrop ..... 52/275
3,298,668 A * 1/1967 Schueren ..... 256/19
(Continued)

*Primary Examiner* — Phi A

(74) *Attorney, Agent, or Firm* — Kilpatrick Townsend & Stockton LLP

(57) ABSTRACT

Concrete masonry unit blocks with recesses providing pockets sized to receive dimensional lumber components, enabling easy design and fabrication of block and lumber assemblies, typically using construction adhesive to bond the blocks to each other. Various dimensions and shapes of blocks are possible, as well as numerous shapes and sizes of pocket-forming recesses in the blocks. A wide variety of attractive and functional structures can be built with the blocks of this invention and widely-available dimensional lumber.

15 Claims, 18 Drawing Sheets

(56) References Cited

U.S. PATENT DOCUMENTS

| | | | | |
|---|---|---|---|---|
| 3,391,507 | A * | 7/1968 | Downing | 52/314 |
| 3,739,541 | A * | 6/1973 | Andrews | 52/220.2 |
| 4,587,782 | A * | 5/1986 | Shubow | E04B 1/161 52/251 |
| 6,199,832 | B1 * | 3/2001 | Morrow | 256/19 |
| 6,224,295 | B1 * | 5/2001 | Price et al. | 405/262 |
| 6,345,474 | B1 * | 2/2002 | Triplett | 52/169.9 |
| 6,625,943 | B1 * | 9/2003 | Renner | E04B 1/165 52/250 |
| 6,663,322 | B1 * | 12/2003 | Listle | 405/239 |
| 6,993,878 | B2 * | 2/2006 | Prokofyev | 52/604 |
| 7,562,613 | B2 * | 7/2009 | Ahmad | 89/36.02 |
| 8,839,593 | B2 * | 9/2014 | Barrett et al. | 52/834 |
| 2003/0089068 | A1 * | 5/2003 | Ameigh | 52/606 |
| 2004/0221538 | A1 * | 11/2004 | Thorpe | 52/596 |
| 2005/0252104 | A1 * | 11/2005 | Sproules | 52/169.9 |
| 2008/0098663 | A1 * | 5/2008 | Seel | 52/36.1 |
| 2008/0134599 | A1 * | 6/2008 | Downing | 52/233 |
| 2008/0250736 | A1 * | 10/2008 | Breaz | 52/220.2 |
| 2011/0265399 | A1 * | 11/2011 | Hahn | 52/173.1 |

* cited by examiner

CONCRETE MASONRY UNIT BLOCKS WITH DIMENSIONAL LUMBER POCKETS AND ASSEMBLIES OF BLOCKS AND LUMBER

CROSS REFERENCE TO RELATED APPLICATION

This patent claims priority to and incorporates by reference U.S. Provisional Patent Application Ser. No. 61/832,360 filed Jun. 7, 2013 for "Concrete Masonry Unit Blocks With Dimensional Lumber Pockets and Assemblies of Blocks and Lumber."

FIELD OF THE INVENTION

This invention relates to concrete masonry unit ("cmu") blocks intended for use together with dimensional lumber and other components.

BACKGROUND OF THE INVENTION

Concrete masonry unit blocks are available that are intended for use with dimensional lumber. These units are scaled to match the lumber sizes. For instance, there are nominal 2"×4" units (actually about 1½"×3½") so that omission of a block of that size from an assembly of such blocks will leave a void sized to receive a portion of a "2×4" piece of lumber. Among other deficiencies, such blocks look small and insubstantial, and assemblies of such blocks require a large number of units because of their relative small size.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

The concrete masonry unit blocks ("cmu blocks") described below and in the claims of this patent may be construction materials manufactured of concrete of any type, and may also be other suitable materials, including, without limitation, other cementitious, cement or masonry products; and structural foam, plastic, plastic composite, reinforced plastic, filled plastic, and polymer materials.

"Dimensional lumber" as used in this patent and its claims means not only lumber cut from wood of trees like pine, spruce and other soft woods, but also hardwoods and other wood products like laminated wood beams (including "gluelam" beams and other structures), oriented strand and composite wood materials, and non-wood materials, including metal (including steel, steel alloy, aluminum and other metal I-beams, H-beams and other metal structures), bamboo, polymer materials, polymer composite materials, fiber cement materials and any other suitable materials typically, but not necessarily, having predetermined cross-sectional shapes and dimensions.

The concrete masonry unit blocks ("cmu blocks") of this invention contain recesses sized to receive dimensional lumber, but the over-all dimensions of the blocks generally are larger than the dimensional lumber with which they are used so that the units are visually (and actually) somewhat larger than blocks that are the same dimensions as typical softwood lumber sizes. This facilitates expeditious assembly of the units into functional structures and results in structures that are visually more substantial-looking and attractive. The overall dimensions of the blocks of this invention are complimentary so that a wide variety of attractive and functional assemblies can be easily made by unskilled users.

Recess-containing concrete masonry unit blocks can also be installed with the recesses facing in, so that there is no visible recess at that location in the structure. Recesses can also receive structures other than dimensional lumber, such as lights, planters, storage drawers, lockboxes and water features. Recesses can face a solid wall of a block, thereby defining a pocket the size of the recess, or two recesses in two blocks may face each other to provide a larger pocket that is the sum of the two recesses, which may be twice the size as each of the two recesses or another size.

Pockets can also receive manufactured structural members like glue laminated ("gluelam") lumber and other engineered wood products like Trus Joist products and components, as well as other structures that are not wood or wood products such as plastic structures, metal I-beams or other metal components. Glass blocks or other components can be back-lighted to provide illumination or desirable visual effects.

The concrete masonry unit blocks of this invention are typically glued together using construction adhesives such as urethanes or other conventional adhesives that are usually dispensed from cartridges for application. Such adhesives are typically used by fully coating mating surfaces with thin layers of adhesives so that the adhesives to not materially separate abutting blocks and therefore do not significantly contribute to the dimensions of the structures. Such adhesive assembly contrasts with conventional assemblies of brick or cmu blocks with mortar that typically is relatively thick, and therefore materially contributes to the size of structures built of conventional brick or cmu and mortar. However, all construction units (and the lumber, if desired), may be bonded with any suitable bonding material, including, without limitation, construction adhesives; polymeric adhesives, including, without limitation, acrylic adhesives, urethane adhesives, polyester adhesives, thermoplastic adhesives and epoxy adhesives; and masonry mortar and other masonry materials. Moreover, in some applications the blocks of this disclosure may be simply stacked without adhesive or may be secured with mechanical fasteners.

The blocks of this invention can be manufactured upright and flat in a standard or large board block machine.

BRIEF DESCRIPTION OF THE DRAWINGS

Illustrative embodiments of the present invention are described in detail below with reference to the following drawing figures.

DETAILED DESCRIPTION

Figure 1:
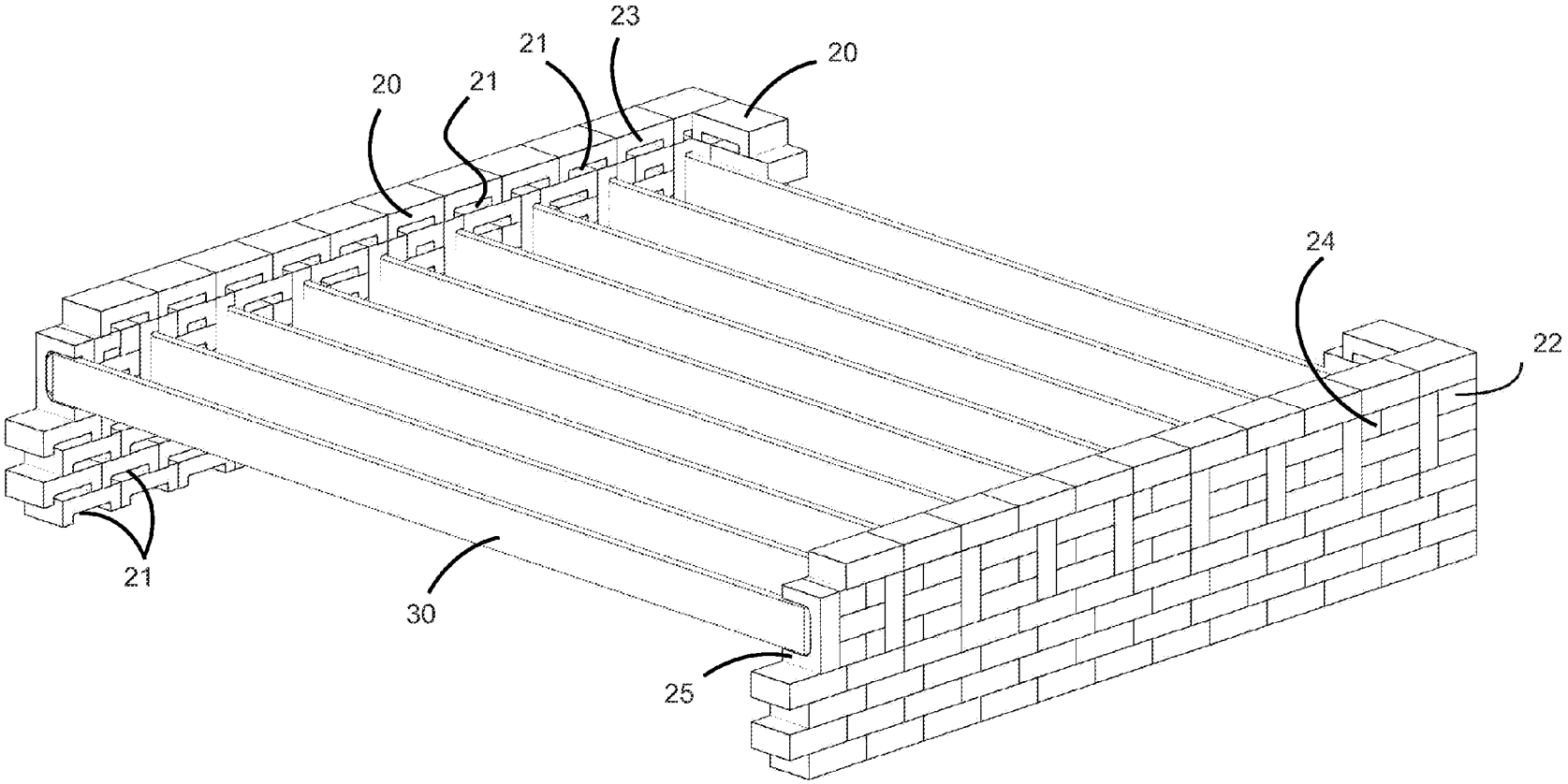
FIGS. 1 and 2 are front and partial rear isometric views of two concrete masonry unit walls in accordance with this invention supporting wood joists.

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

North American softwood framing lumber (used, for example, for studs, joists, plates and the like in building houses and other structures) are identified by their nominal width and thickness dimensions in inches and length in feet. The actual width and thicknesses of such lumber is less than the nominal sizes. The following table sets forth the typical actual dimensions opposite the nominal sizes. These nominal sizes are routinely used to refer to such lumber. These dimensions are generally applicable to both treated and untreated wood lumber and are often also used for man-made construction materials such as manufactured wood, fiber-cement and polymer products.

| Nominal Lumber Dimensions in inches | Actual Lumber Dimensions in inches (and millimeters) |
|---|---|
| 1 × 2 | ¾ in × 1½ in (19 mm × 38 mm) |
| 1 × 3 | ¾ in × 2½ in (19 mm × 64 mm) |
| 1 × 4 | ¾ in × 3½ in (19 mm × 89 mm) |
| 1 × 6 | ¾ in × 5½ in (19 mm × 140 mm) |
| 1 × 8 | ¾ in × 7¼ in (19 mm × 184 mm) |
| 1 × 10 | ¾ in × 9¼ in (19 mm × 235 mm) |
| 1 × 12 | ¾ in × 11¼ in (19 mm × 286 mm) |
| 2 × 2 | 1½ in × 1½ in (38 mm × 38 mm) |
| 2 × 3 | 1½ in × 2½ in (38 mm × 64 mm) |
| 2 × 4 | 1½ in × 3½ in (38 mm × 89 mm) |
| 2 × 6 | 1½ in × 5½ in (38 mm × 140 mm) |
| 2 × 8 | 1½ in × 7¼ in (38 mm × 184 mm) |
| 2 × 10 | 1½ in × 9¼ in (38 mm × 235 mm) |
| 2 × 12 | 1½ in × 11¼ in (38 mm × 286 mm) |
| 4 × 4 | 3½ in × 3½ in (89 mm × 89 mm) |
| 4 × 6 | 3½ in × 5½ in (89 mm × 140 mm) |
| 6 × 6 | 5½ in × 5½ in (140 mm × 140 mm) |
| 8 × 8 | 7¼ in × 7¼ in (184 mm × 184 mm) |

The blocks of this invention may be manufactured with recesses that serve, either alone or together with another recess, to form pockets intended to receive and hold portions of some of the more commonly used sizes of softwood lumber.

The blocks of this invention may also be sized for assembly with other blocks without the significant thicknesses of bonding material like the mortar usually placed between bricks or conventional cmu blocks. Instead, the blocks are assembled with nothing between adjacent blocks or, more typically, with adhesive between abutting blocks to secure those blocks to each other without appreciably separating the blocks from each other. Block assemblies of this invention containing lumber-sized pockets are superior to other systems that have blocks the same cross-sectional dimensions as the lumber with which they are used so that pockets are formed by omitting blocks. In such other block systems, the blocks are too small to be aesthetically pleasing, and such smaller sizes require more blocks for a particular size of structure, making assembly of such a structure more demanding in terms of time and (at least) adhesive materials.

The cmu blocks of this invention contain recesses or voids dimensioned to receive portions of standard dimensional softwood lumber so that structures of such blocks and standard lumber can be easily and quickly designed and constructed. Such recesses or voids also reduce the weight of a cmu block containing such a void or pocket as compared to a like-sized cmu block without a recess or void. Such recesses or voids can face inward in block assemblies if it is desired that they not be visible.

The actual dimensions of a particular piece of lumber at a particular point in time may vary a little from the "actual size" set forth in the chart above because of variations in planning during processing, variations in moisture content and because of shape changes, such as "cupping," that a piece of lumber may experience over time. The cross-grain dimensions of lumber vary by measurable, sometimes significant amounts with changes in moisture content as the lumber "dries" from its "green" moisture content when the timber was cut and in response to changes in the moisture content of the air surrounding the lumber after it has been "dried." Accordingly, it will typically be desirable to manufacture blocks of this invention containing or forming pockets that are modestly larger than the intended actual lumber dimensions shown in the chart above. For instance, the pockets may be formed ⅛ inch larger in thickness and in width than the actual lumber dimensions of the lumber with which the blocks are to be used.

In addition to square and rectangular blocks, blocks may be in the form of a trapezoid so that two facing pairs of such trapezoidal blocks measure 4×8×12 (or any other desired dimensions).

Nominal block dimensions and nominal and actual pocket dimensions may include these exemplary recesses:

| Nominal Block Dimensions | Nominal Recess, if included | Actual Recess dimensions, not including allowance for over-size lumber |
|---|---|---|
| 4 × 4 × 8 solid | NA | |
| 4 × 4 × 8 with a pocket | 2 × 4 | 1½ in × 3½ in (38 mm × 89 mm) |
| 4 × 8 × 8 solid | NA | |
| 4 × 8 × 8 with a pocket | 2 × 4 through pocket | 1½ in × 3½ in (38 mm × 89 mm) |
| 4 × 8 × 12 solid | NA | |
| 4 × 8 × 12 with a pocket | 2 × 8 | 1½ in × 7¼ in (38 mm × 184 mm) |

Figure 2:
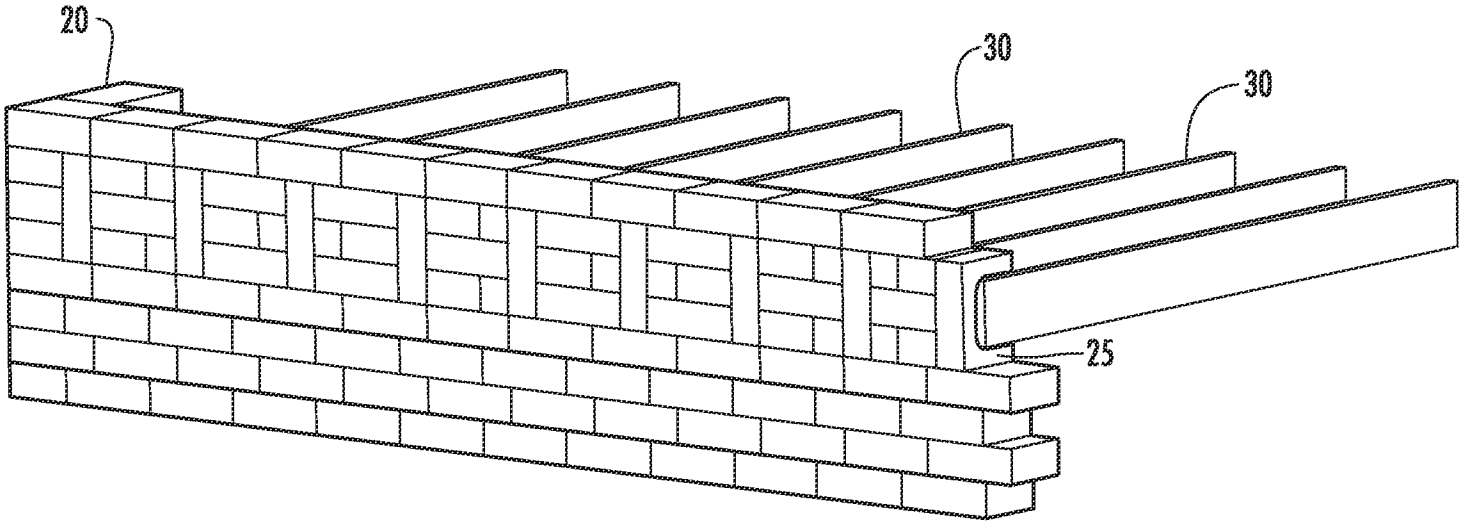
Figure 10:
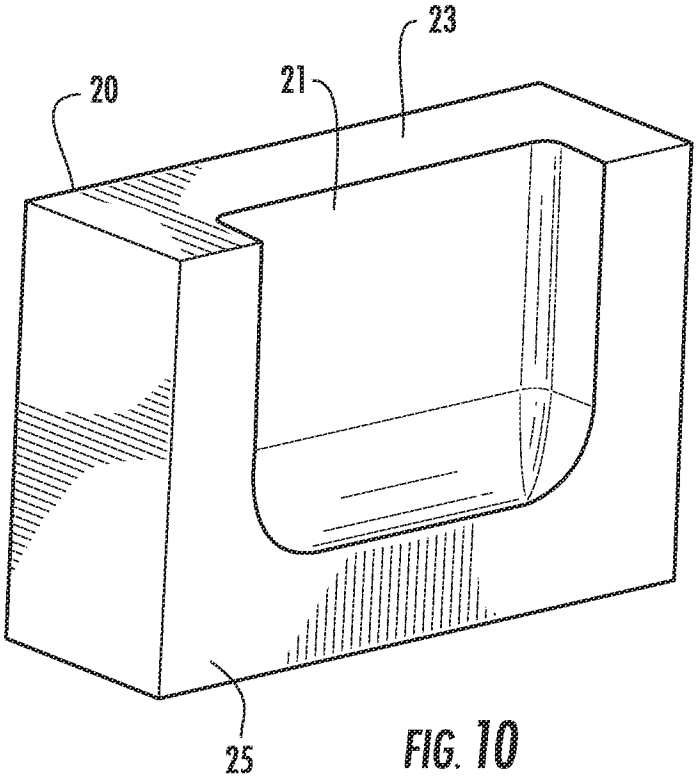
FIGS. 9 and 10 are front and rear views of a cmu block of this invention having a dimensional lumber-receiving recess.
Figure 9:
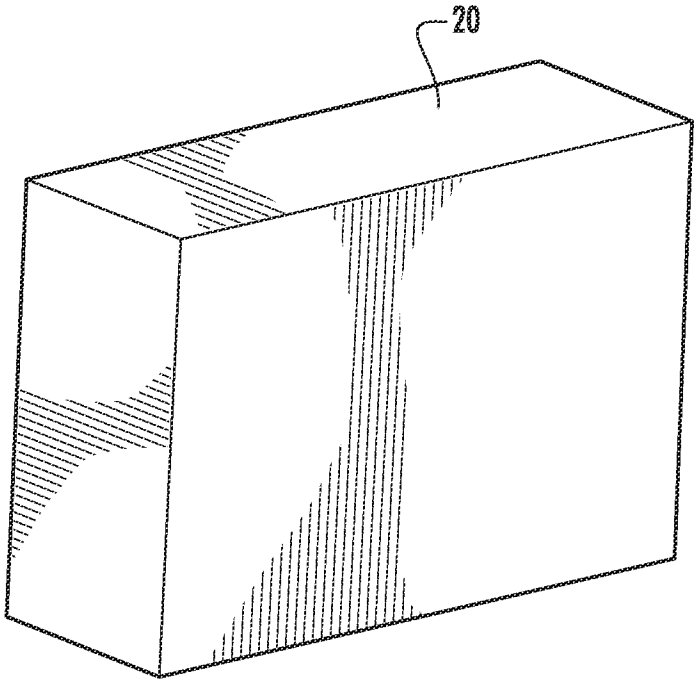

Exemplary blocks 20, 22 and 24 of this invention are illustrated in FIGS. 1 and 2 stacked into low walls that support a series of joists 30. Blocks 20 can be 4"×8"×12" and are depicted separately in FIGS. 9 and 10. Blocks 20 measuring 4"×8"×12", blocks 22 measuring 4"×8"×8" and blocks 24 measuring 4"×4" by 8", are shown assembled into the low wall structures depicted in FIGS. 1 and 2.

The joists 30 may be (so called) "2×8" joists having the nominal and actual dimensions set forth in the table above. As is most easily seen in FIGS. 9 and 10, the 4"×8"×12" blocks 20 have a recess 21 nominally 2 inches by 8 inches on the 4" by 12" block 20 face 23 and nominally six inches by 8 inches on the 8" by 12" block 20 face 25. This permits a length of approximately five inches of the end of joist 30 to be received in the recess 21.

As depicted in FIGS. 1 and 2, the blocks 22 and 24 may also have recesses usable to provide lumber-receiving pockets, but no lumber is shown positioned in those recesses in these figures.

Figure 20:
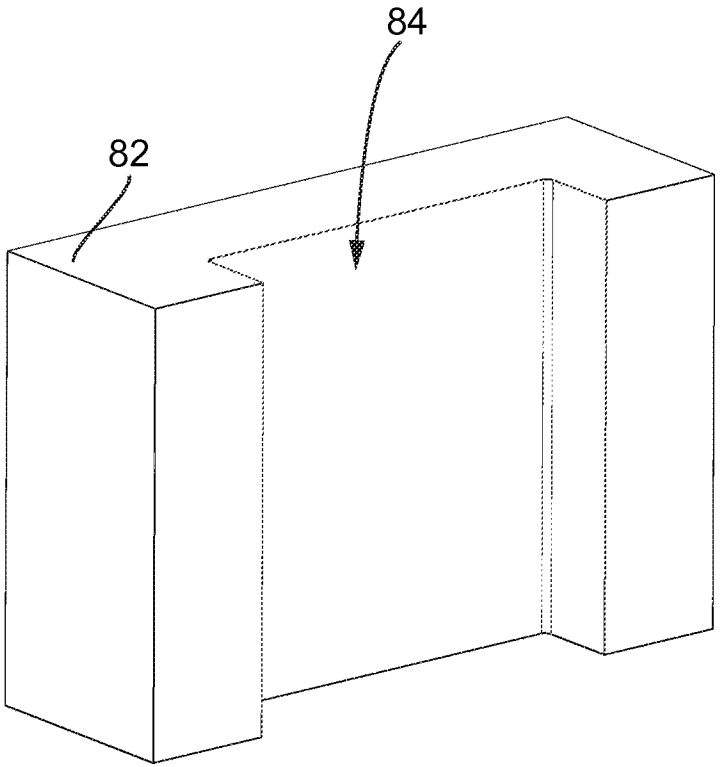
FIG. 20 is an isometric view of a block 82 having a through pocket 84.
Figure 19:
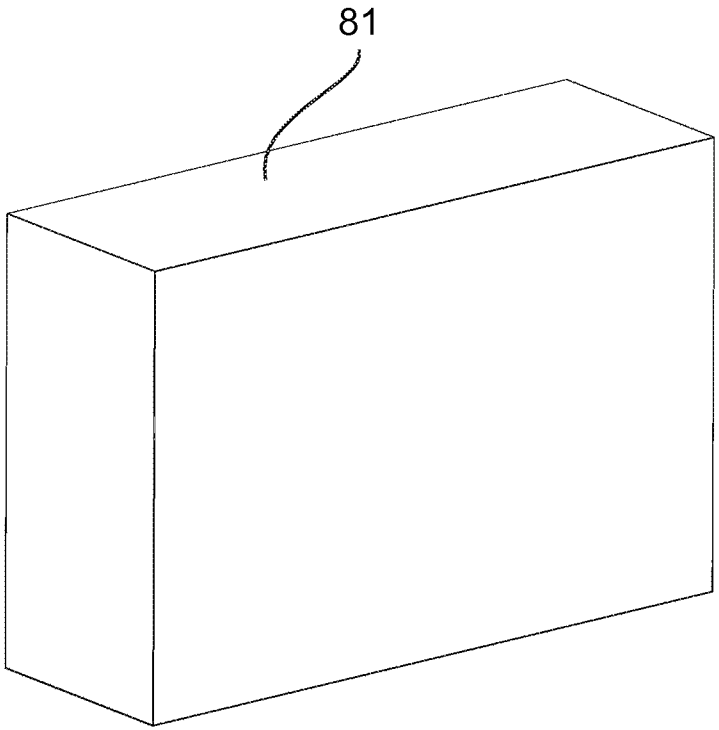
FIG. 19 is a is an isometric view of a solid block 81.

As depicted in FIGS. 19 and 20, solid block 81 could also be produced as a block 82 having a through pocket 84. Other shapes and sizes of blocks could also have through pockets if desired to permit lumber or other components to pass all the way through a block or blocks and the structure in which such block or blocks are used.

Figure 3:
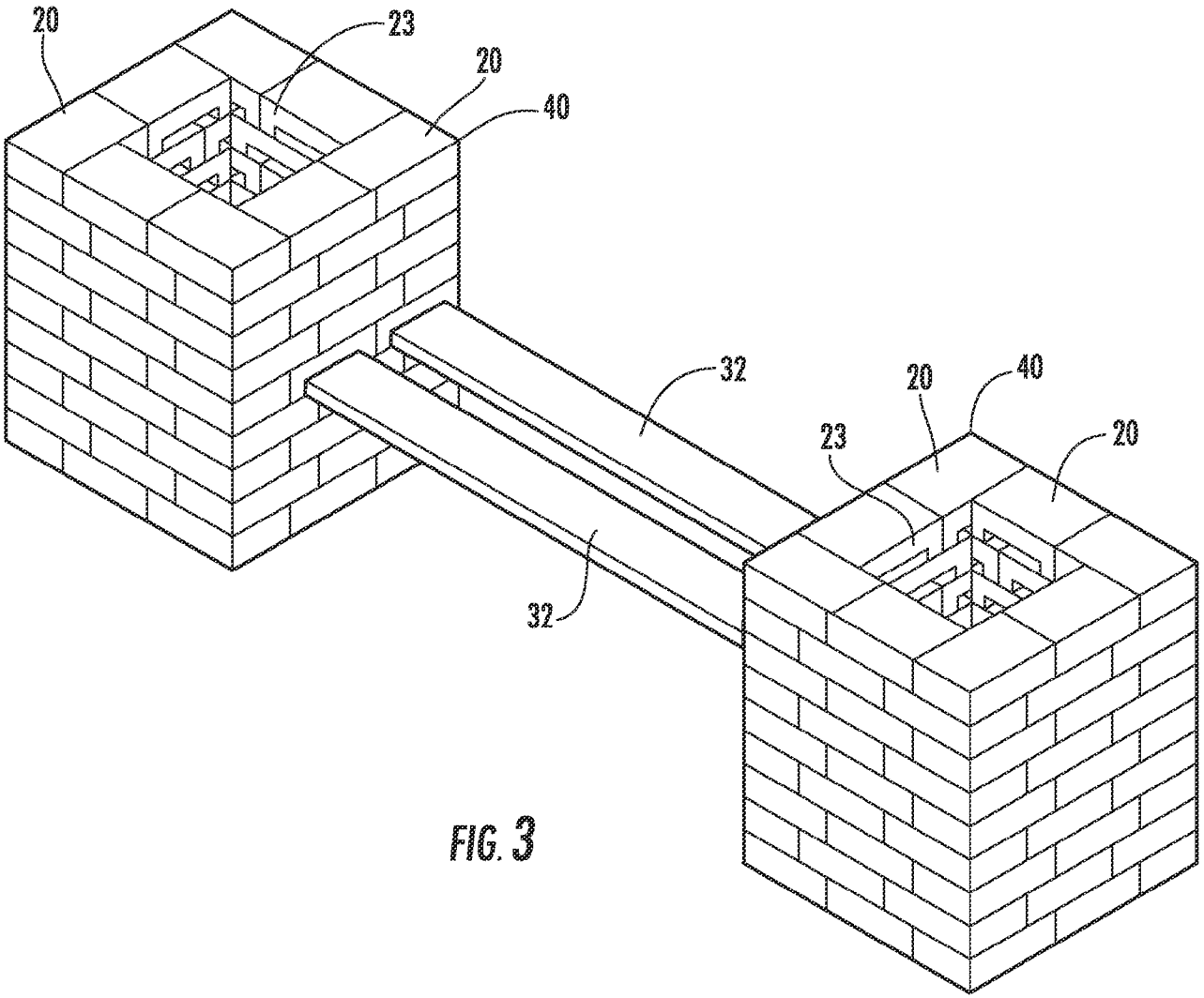
FIGS. 3 and 4 are front and rear isometric views, respectively, of two concrete masonry unit square columns in accordance with this invention supporting two horizontally oriented dimensional lumber members.
Figure 4:
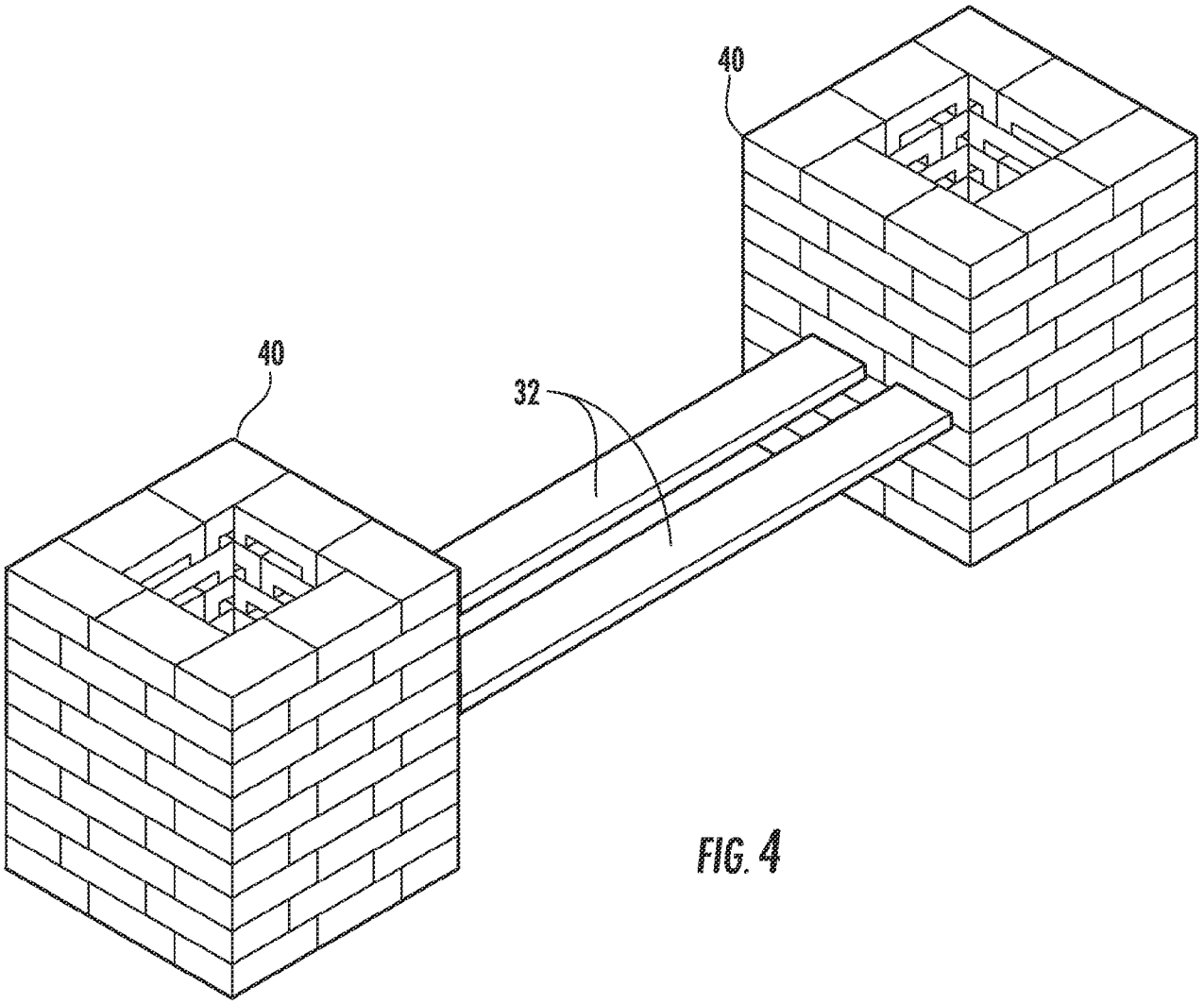
Figure 5:
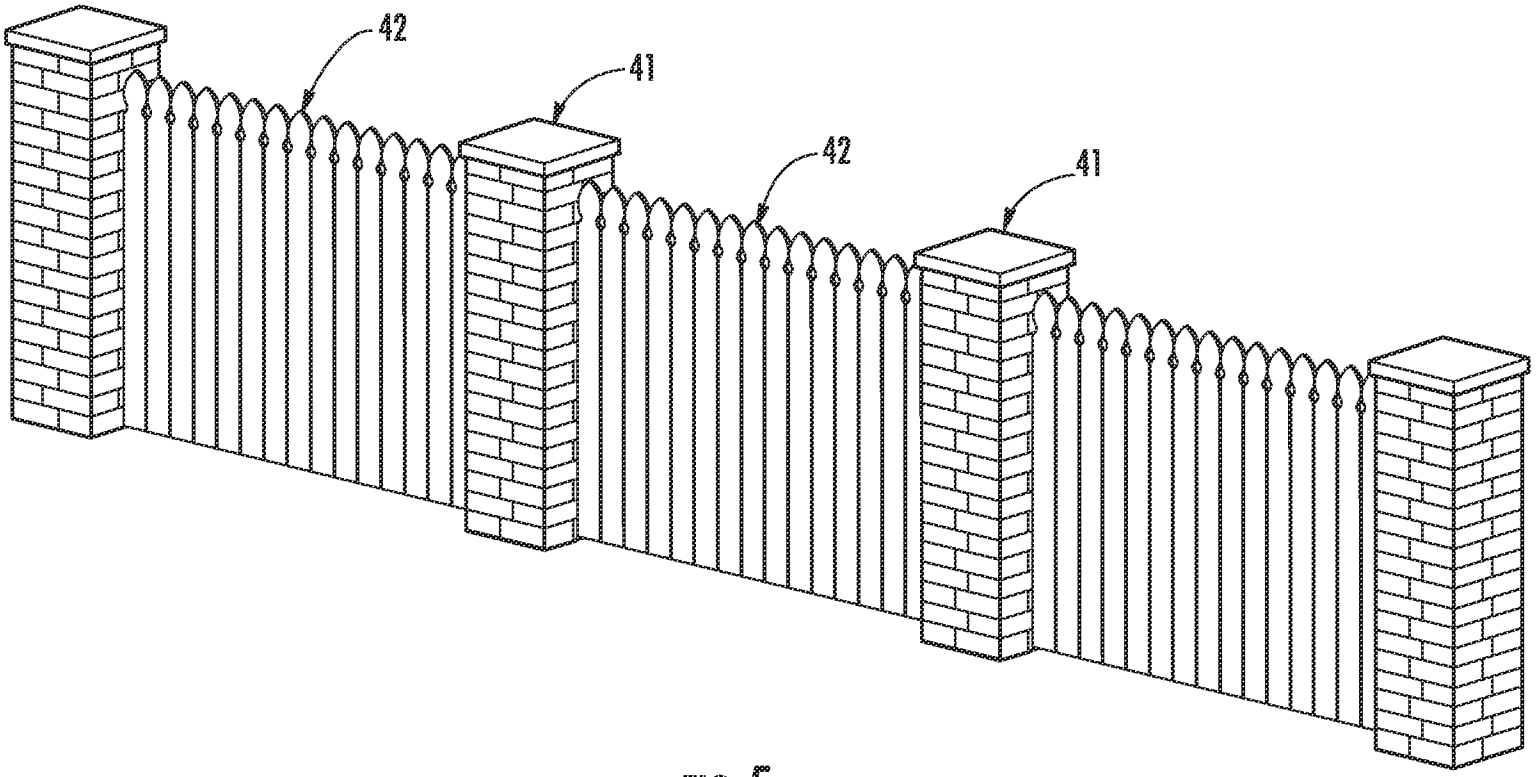
FIGS. 5 and 6 are front and rear isometric views, respectively, of three concrete masonry unit square columns shown with a fence panel between each of the pairs of columns.
Figure 6:
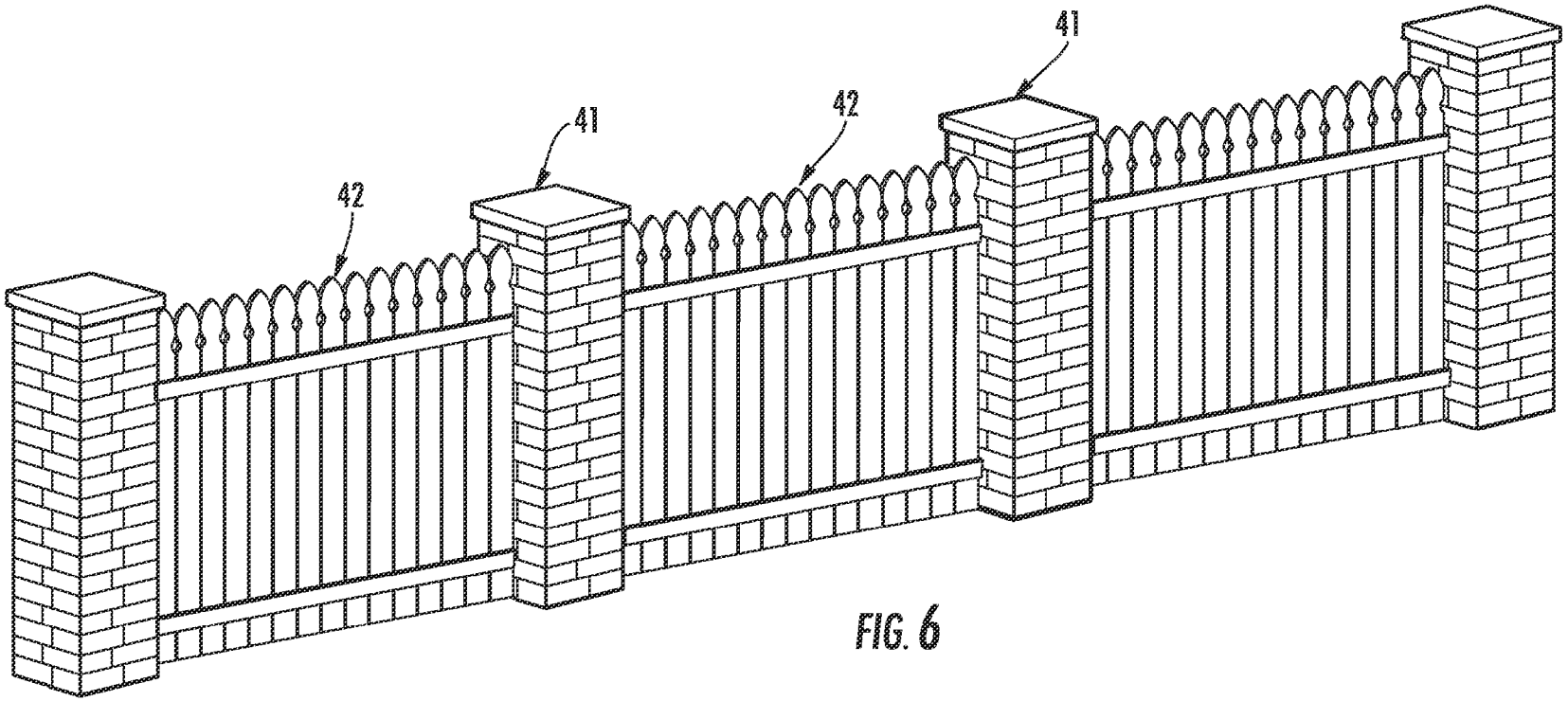
Figure 7:
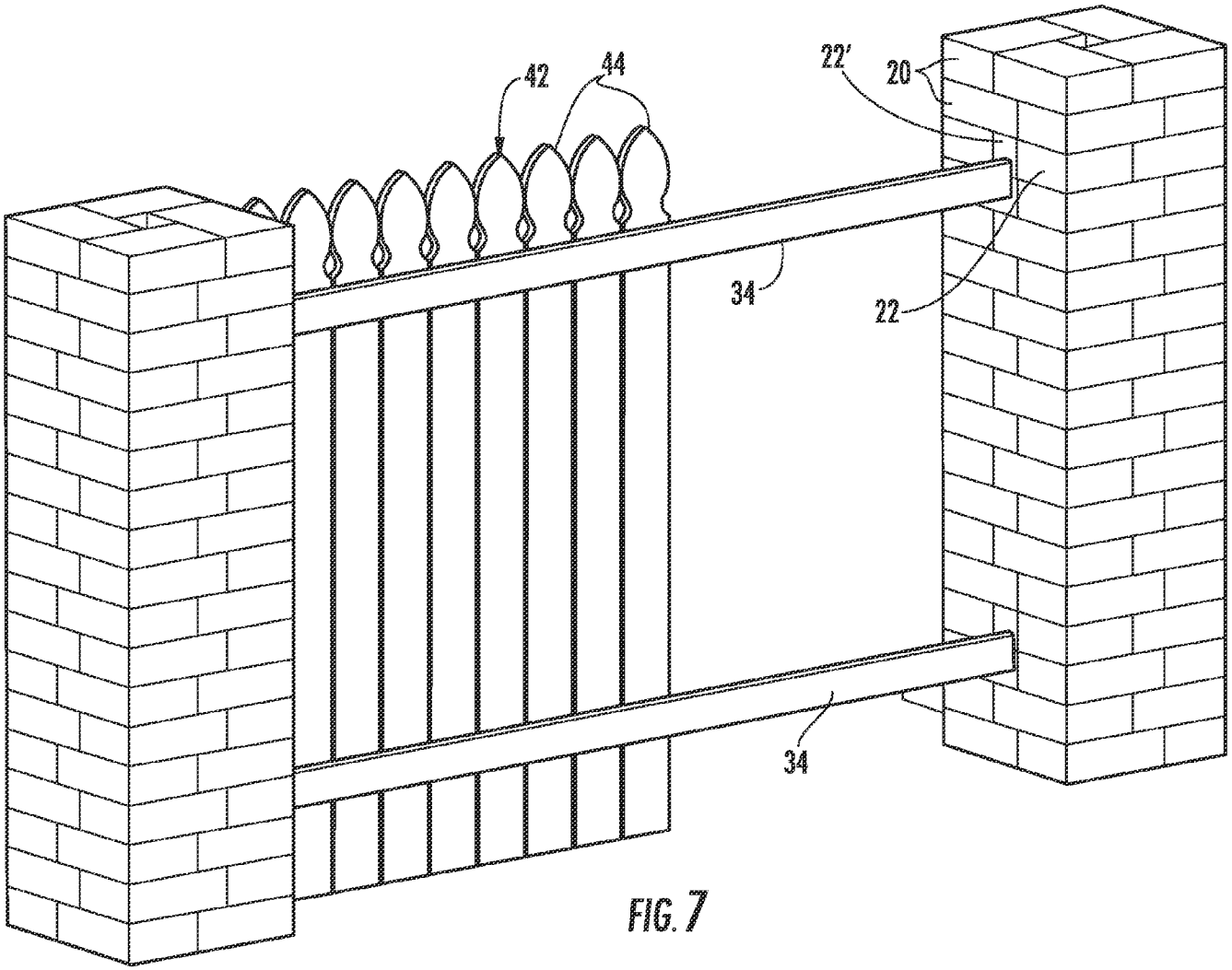
FIG. 7 is enlarged rear isometric view of two of the posts shown in FIGS. 5 and 6 with one fence panel, from which some of the pickets have been removed.
Figure 8:
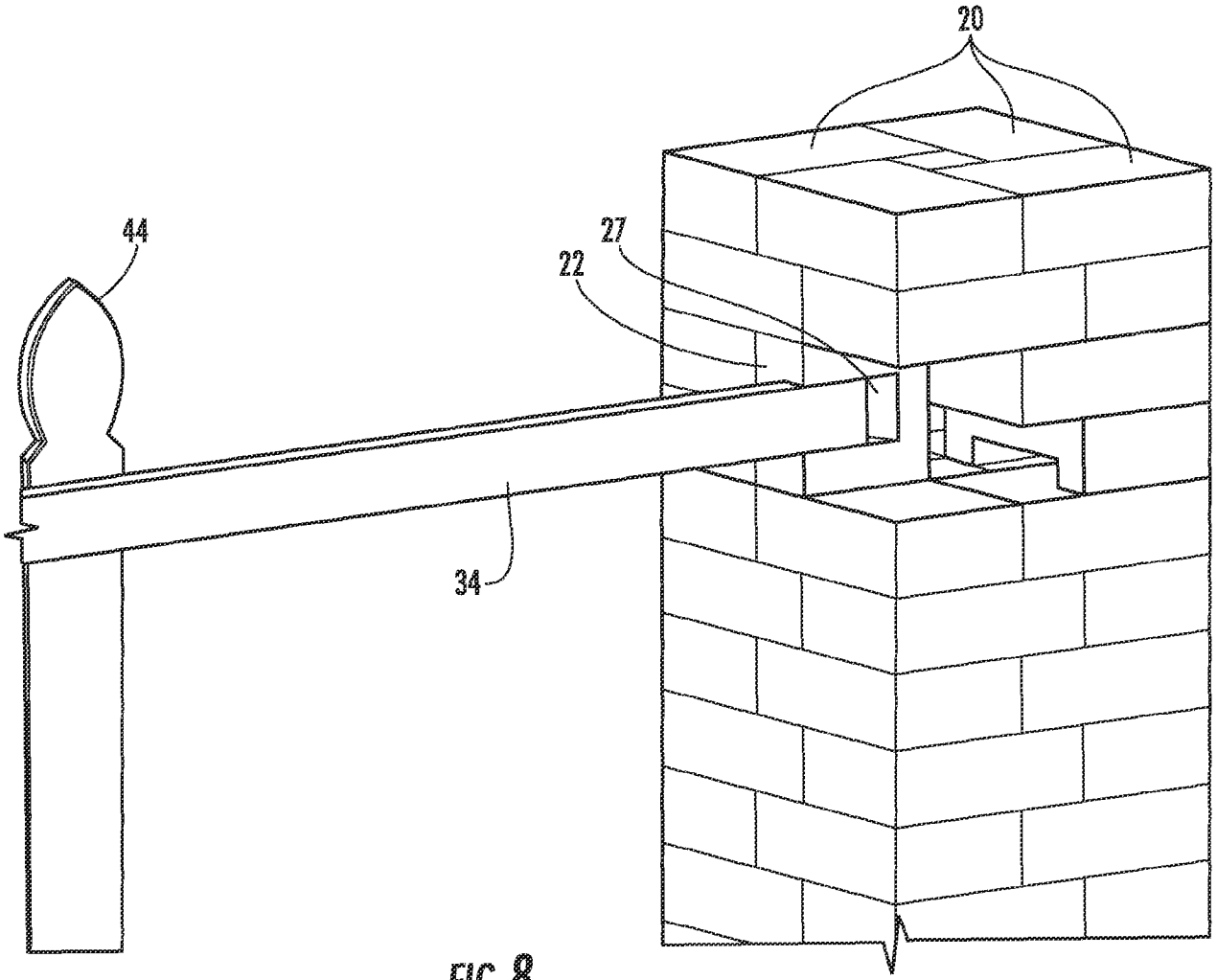
FIG. 8 is a further enlarged rear isometric view of one of the posts and a portion of the panel of FIG. 7 shown with two of the cmu blocks removed.

FIGS. 3 and 4 depict two square columns 40 formed solely of blocks 20. Two of the blocks 20 in each of the columns 40 are oriented with their faces 23 out, so that the recess 21 in each such block 20 provides a pocket that receives an end of a horizontally oriented 2×8 board 32.

FIGS. 5, 6, 7 and 8 depict square columns 41 supporting, between pairs of columns 41, fence panels 42 made of pickets 44 attached to horizontal supports 34. Square columns 41 are assembled from blocks 20 (4"×8"×12") and 4"×8"×8" blocks 22 or 22'. Blocks 22 are oriented with a 2"×4"×6" recess facing out so that it can provide a pocket for receiving an end of 2×4 lumber or, as depicted in FIGS. 5-8, blocks 22' include a 2"×4"×(approximately) 6" recess with the 2"×4" portion facing out to receive an end of 2×4 lumber 34.

Figure 11:
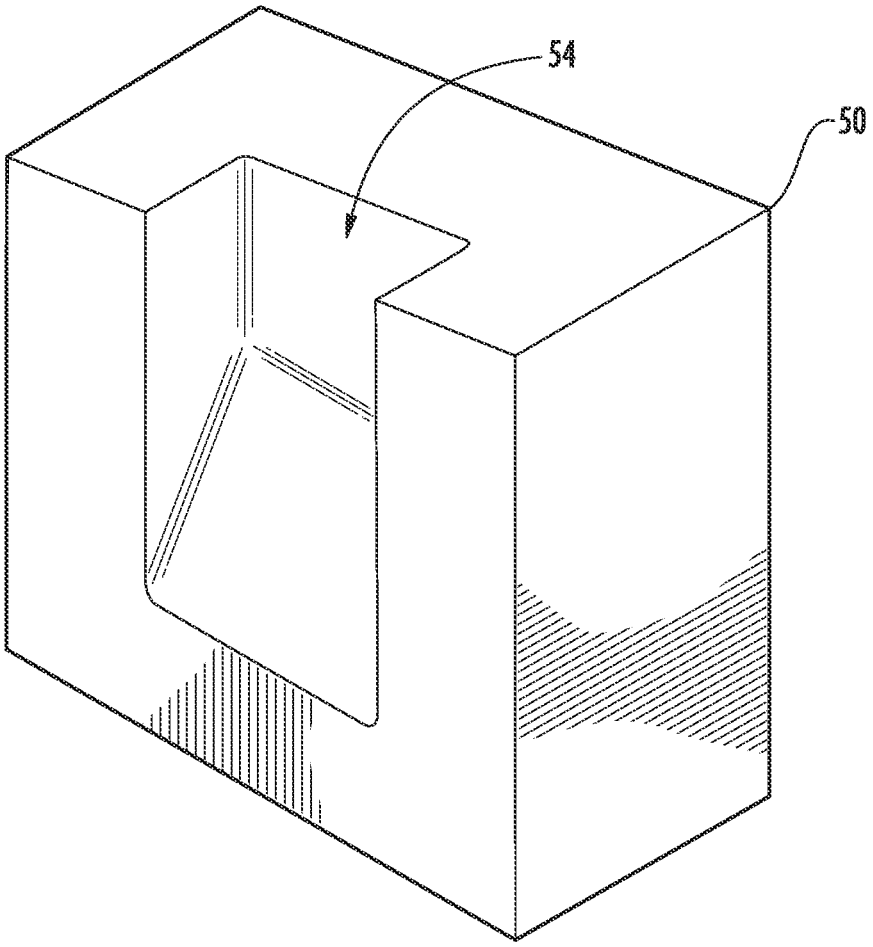
FIG. 11 is an isometric view of a "right hand" tapered cmu block of this invention having a dimensional lumber-receiving recess.
Figure 12:
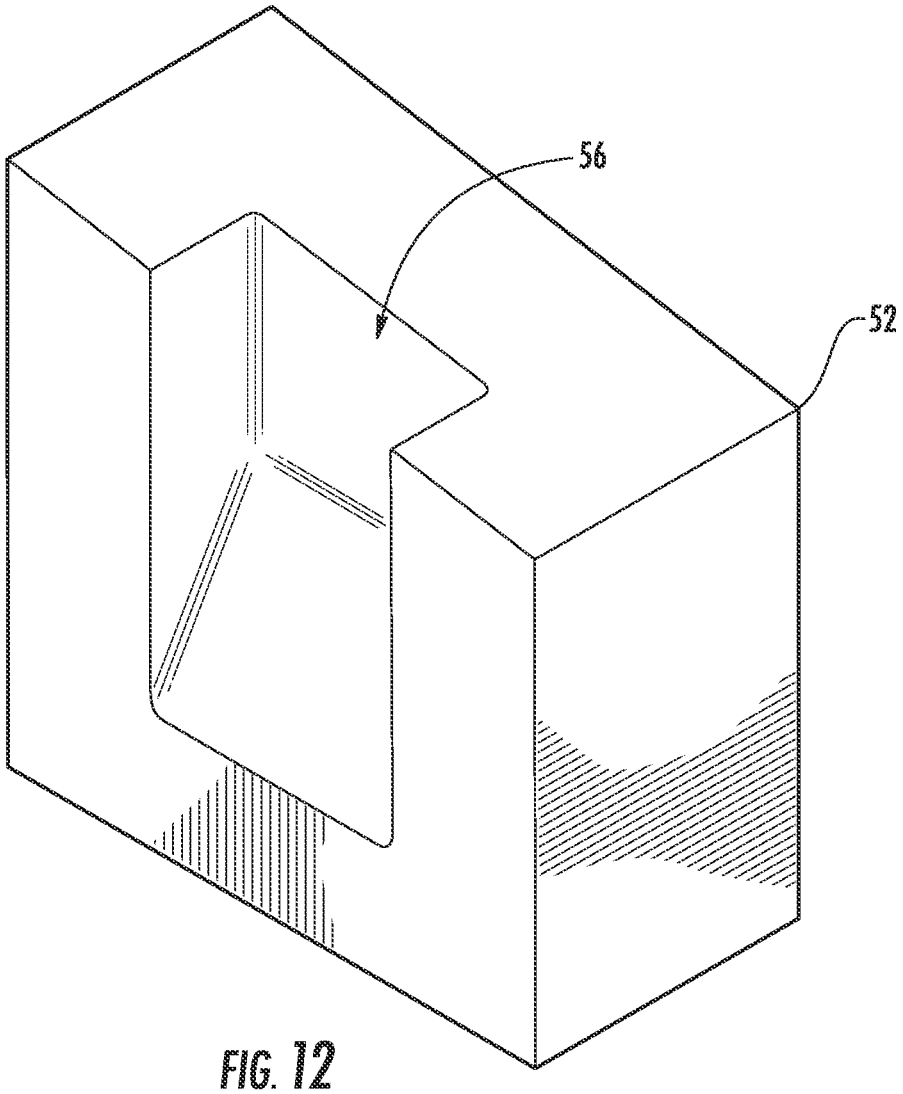
FIG. 12 is an isometric view of a "left hand" tapered cmu block of this invention having a dimensional lumber-receiving recess.
Figure 13:
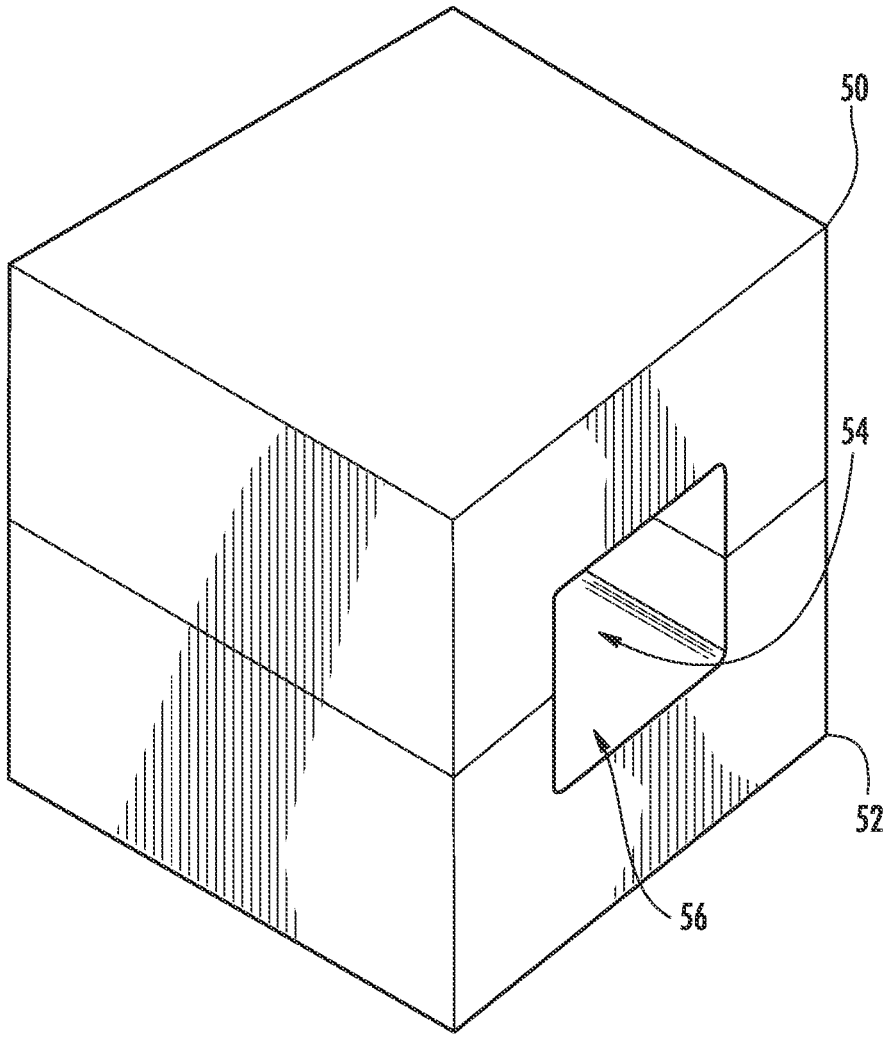
FIG. 13 is an isometric view of a pair of the blocks shown in FIGS. 11 and 12 with facing recesses and the trapezoidal block faces oriented horizontally.
Figure 14:
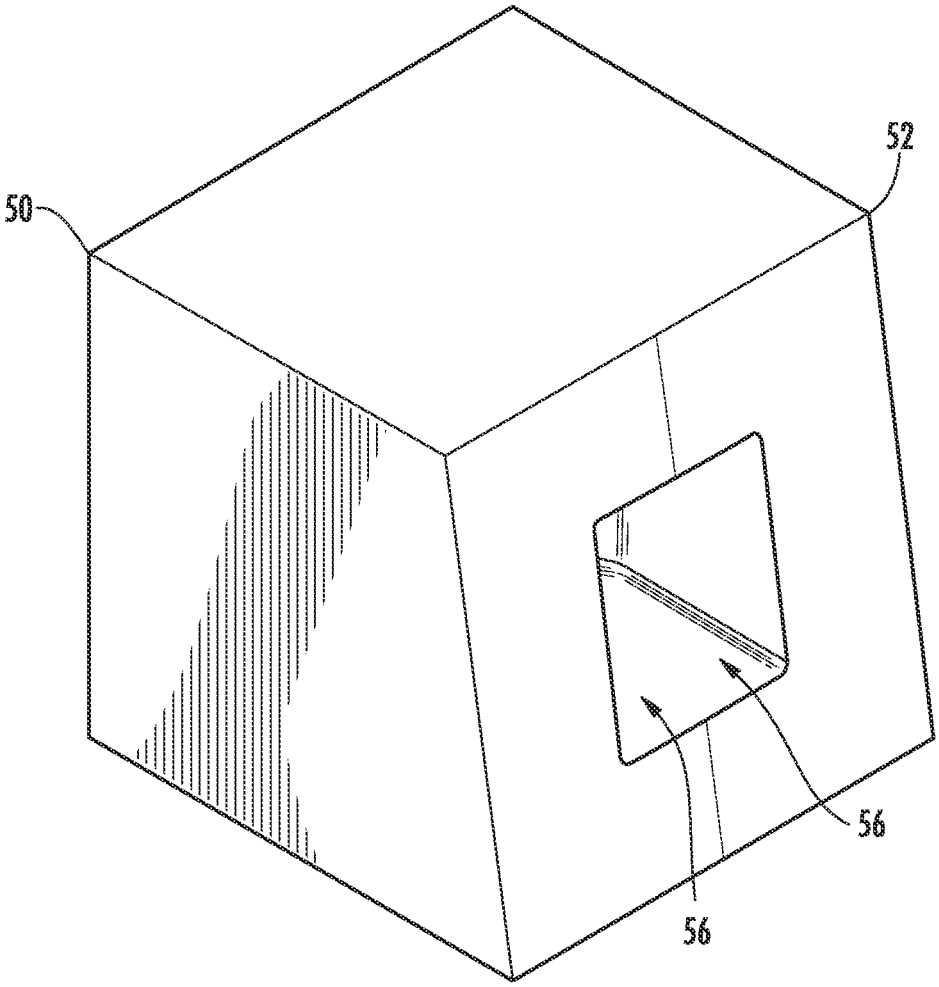
FIG. 14 is an isometric view of the same pair of blocks shown in FIG. 13, also with facing recesses but with the trapezoidal faces oriented vertically.

FIGS. 11 and 12 depict "right hand" 50 and "left hand" 52, respectively, tapered cmu blocks of this invention having dimensional lumber-receiving recesses 54 and 56, respectively. Each of FIGS. 13 and 14 depict a pair of tapered cmu blocks 50 and 52 with facing recesses 54 and 56. Each of the recesses is sized to receive a portion of 2×4 lumber, and the paired recesses 56 and 56 depicted in FIGS. 13 and 14 can receive a portion of 4×4 dimension lumber.

FIGS. 15-18 depict exemplary block and lumber assemblies of this invention utilizing tapered, pocket-containing blocks 50 and 52.

Figure 15:
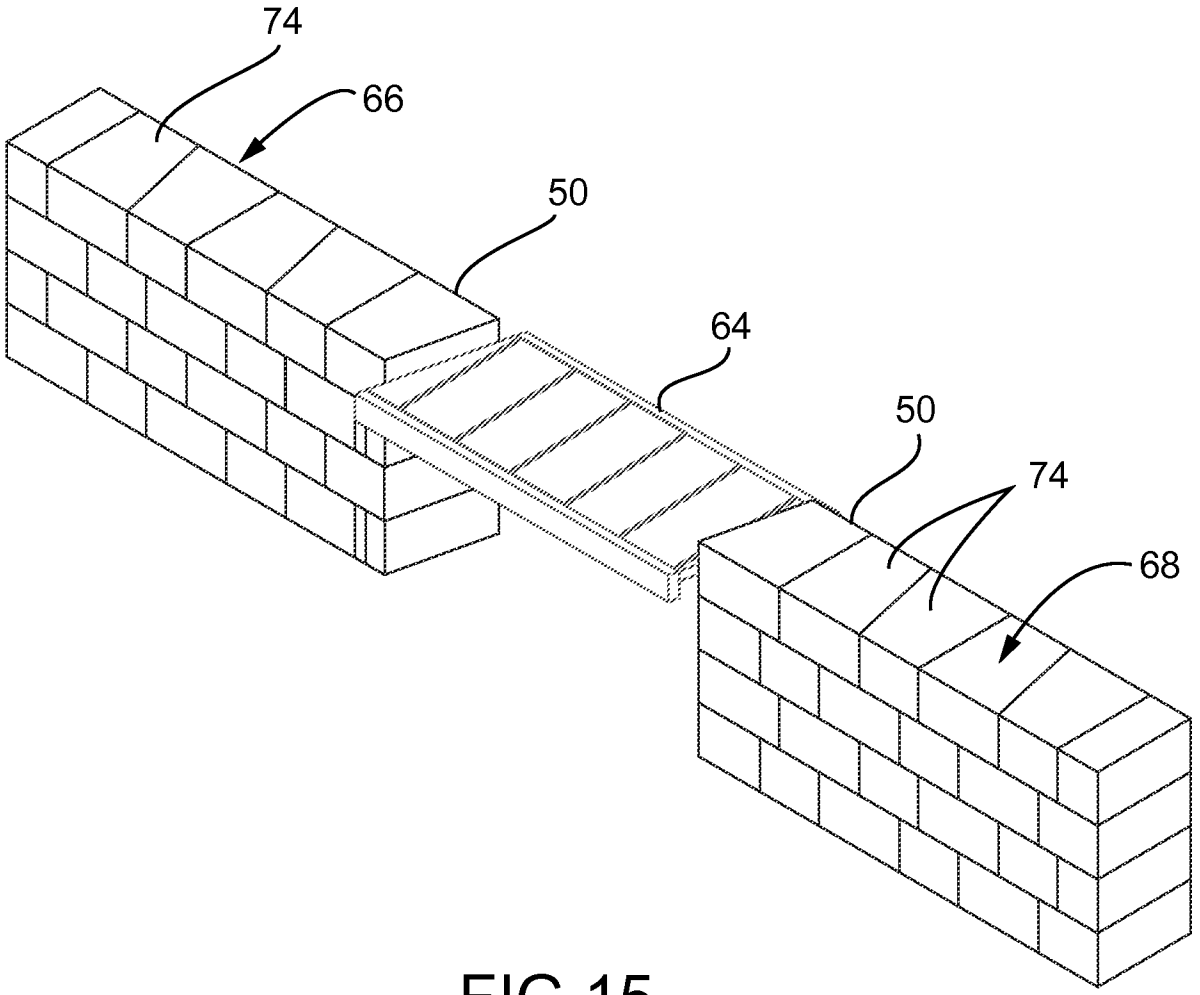
FIG. 15 is an isometric view of two block walls of this invention aligned end to end with a table spanning the space between those ends.
Figure 17:
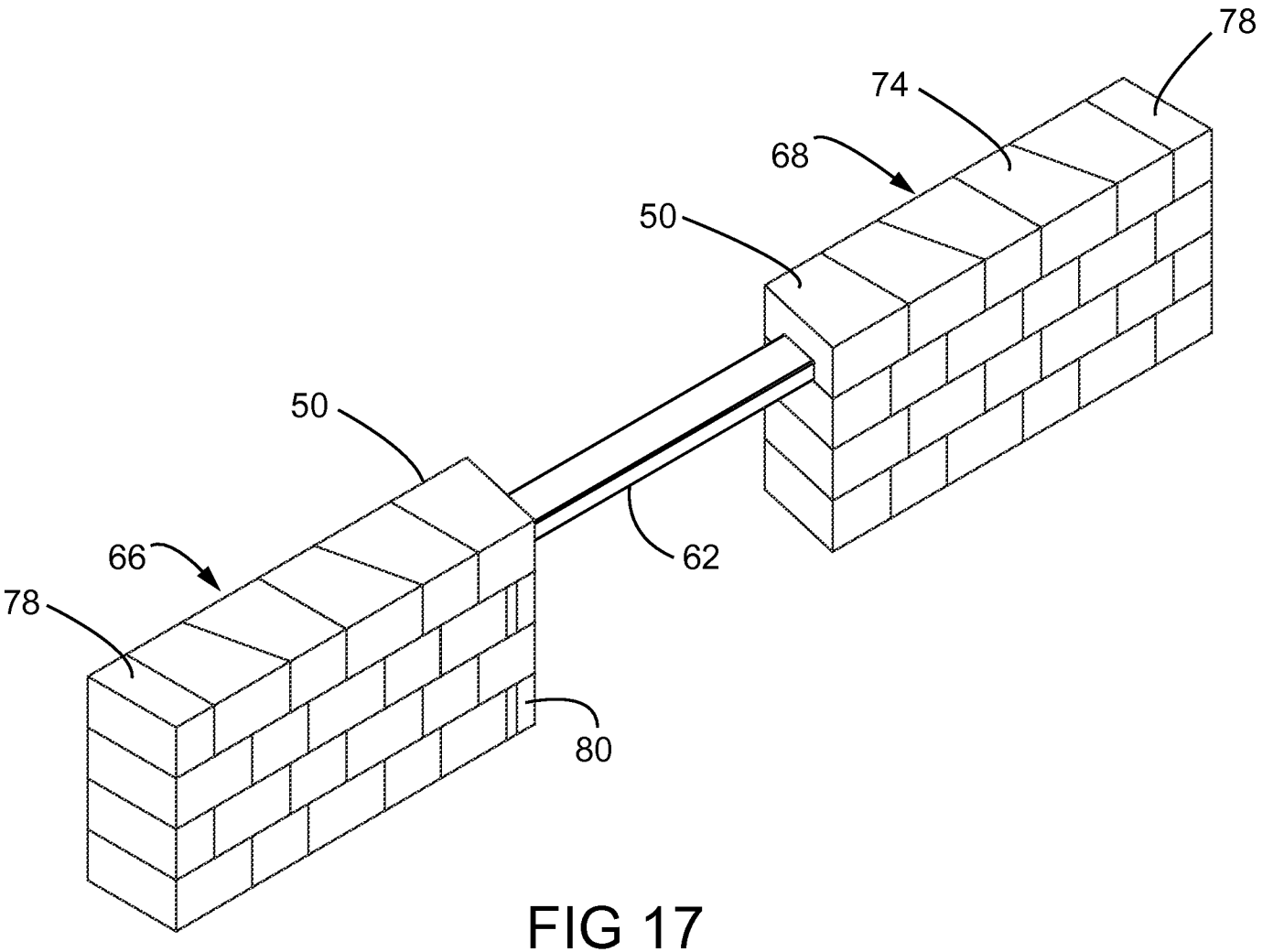
FIG. 17 is an isometric view of the two block walls depicted in FIG. 15 but with a single wood 2×4 spanning the space between the two wall ends.

Like pairs of walls 66 and 68 of this invention appear in FIGS. 15 and 17. Walls 66 and 68 use tapered blocks, such as block 50 (with a recess) and block 74 (that need not have a recess) together with rectilinear blocks 78 and cut blocks 80. Tapered blocks 50 and 74 are stacked facing in alternating directions, so that walls 66 and 68 are straight.

Blocks 50 on opposed ends of each of walls 66 and 68 face each other and each receive one end of 2×4 62, as may be seen in in FIG. 17. A table 64 rests on and obscures 2×4 62 in FIG. 15.

Figure 18:
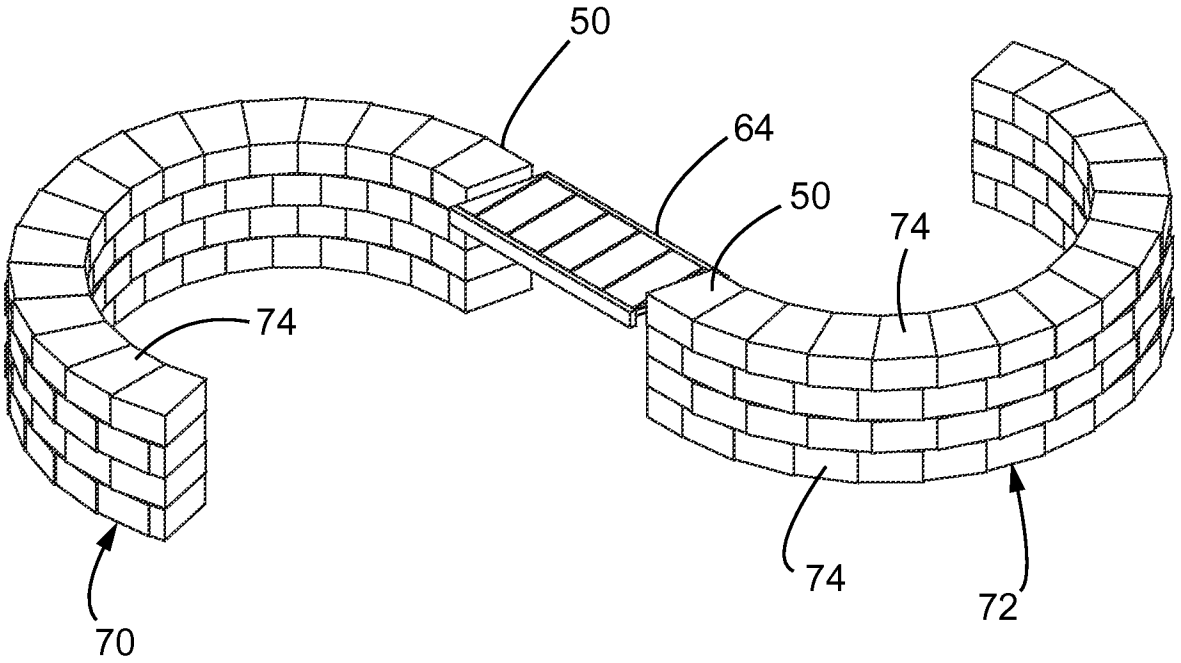
FIG. 18 is an isometric view of two serpentine block walls of this invention with opposed wall ends and a wood table spanning the space between those ends.

An identical table 64 is also supported between blocks 50 on facing wall ends in FIG. 18, but the walls 70 and 72 in FIG. 18 are built entirely of tapered blocks 50 and 74 facing the same way, so that each wall 70 and 72 is curved rather than straight.

Figure 16:
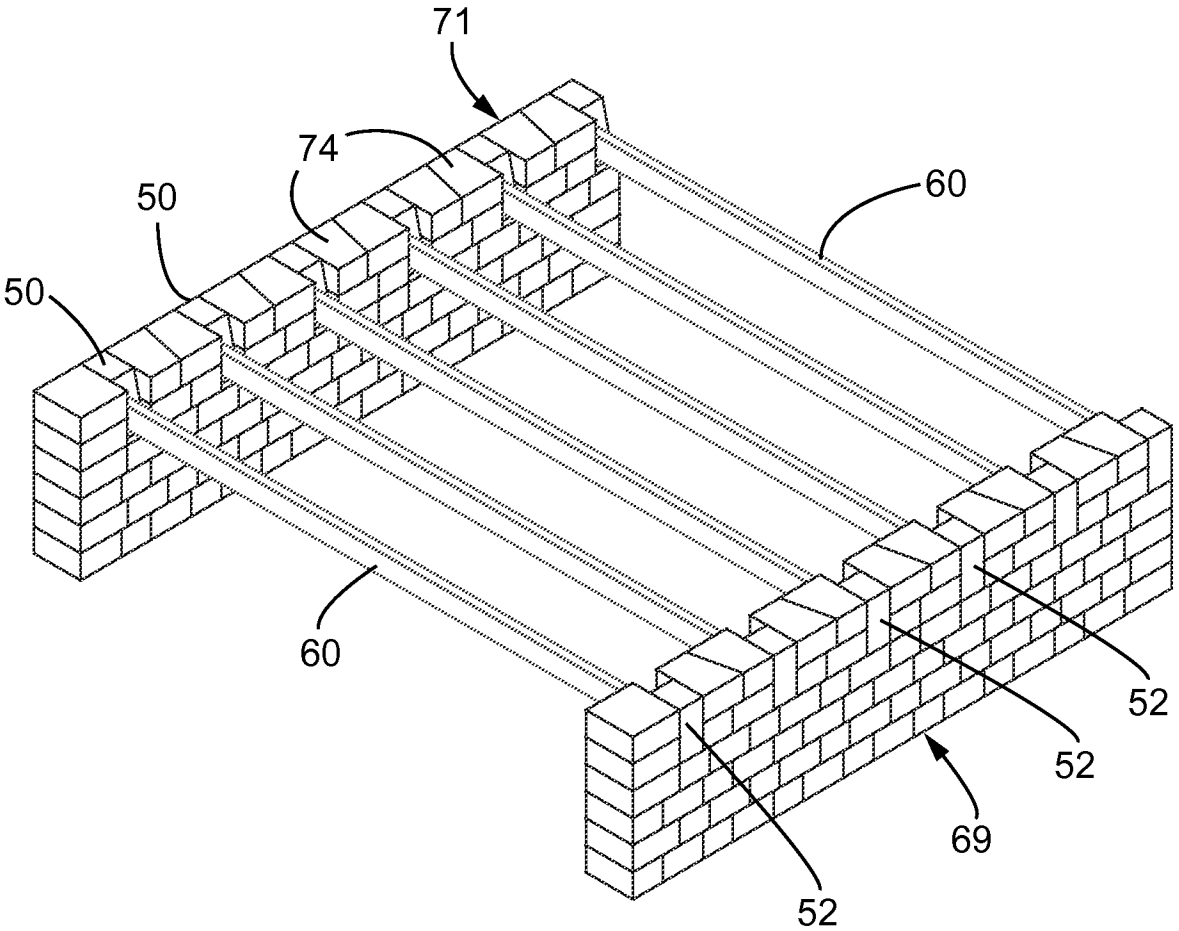
FIG. 16 is an isometric view of two parallel block walls of this invention together with wood joists spanning the space between the walls.

Facing straight walls 69 and 71 appear in FIG. 16 supporting 2×4 wood joists 60. Each joist 60 end is received in a tapered block 50 (in wall 71) or 52 (in wall 69. Walls 69 and 71 use tapered blocks 74 facing in alternating directions, together with other blocks as needed so that walls 69 and 71 are straight.

Different arrangements of the components depicted in the drawings or described above, as well as components and steps not shown or described are possible. Flexibility in design and construction of components, and of assemblies of components, are among the hallmarks of this invention, so many components and structures in addition to those depicted and described here are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the claims below.

That which is claimed is:

1. An assembly of at least two concrete masonry unit blocks and at least one lumber component, wherein each block comprises a first face and an adjacent second face, wherein the first face and the second face share a common edge; and a three-dimensional cutout region in each block formed by a first opening in a portion of the first face in open communication with a second opening in a portion of the second face;

wherein a first block is arranged so that the first face is substantially horizontal;

wherein a second block is arranged so that the first face is substantially vertical and the second opening is accessible from an exterior surface of the assembly so as to form an insertion region for a predetermined portion of the at least one lumber component;

wherein the insertion region has dimensions that correspond to dimensions of the predetermined portion to create a snug fit between the insertion region and the predetermined portion;

wherein the three-dimensional cutout region further comprises a tapered end region adjacent the insertion region, wherein the tapered end region has dimensions smaller than the predetermined portion to prevent insertion of the predetermined portion into the tapered end region.

2. The assembly of claim 1, wherein the first block is arranged so that the first opening is facing downward.

3. The assembly of claim 1, further comprising at least a third block abutting the second face of the first block so that the second opening of the first block is not accessible from the exterior surface of the assembly.

4. The assembly of claim 1, further comprising at least a third block abutting the first face of the second block to form a three-dimensional pocket between the second block and the third block.

5. The assembly of claim 4, wherein the third block comprises a first face and an adjacent second face, wherein the first face and the second face share a common edge, and a three-dimensional cutout region formed by a first opening in a portion of the first face in open communication with a second opening in a portion of the second face; and the second block and the third block are arranged so that the first openings of the second block and the third block confront each other to form an expanded three-dimensional pocket between the second block and the third block.

6. The assembly of claim 1, further comprising a third block abutting the first face of the first block to form a three-dimensional pocket between the first block and the third block.

7. The assembly of claim 6, wherein the third block comprises a first face and an adjacent second face, wherein the first face and the second face share a common edge, and a three-dimensional cutout region formed by a first opening in a portion of the first face in open communication with a second opening in a portion of the second face; and the first block and the third block are arranged so that the first openings of the first block and the third block confront each other to form an expanded three-dimensional pocket between the first block and the third block.

8. The assembly of claim 1, wherein each block is tapered with the second face not parallel to an opposing face of the block.

9. The assembly of claim 8, wherein at least the first face is in the shape of a trapezoid.

10. An assembly of at least two concrete masonry unit blocks and at least one lumber component, wherein each block comprises a first face and an adjacent second face, wherein the first face and the second face share a common edge; and a three-dimensional cutout region in each block formed by a first opening in a portion of the first face in open communication with a second opening in a portion of the second face;

wherein a first block is arranged so that the first face is substantially horizontal and the first opening is facing downward;

wherein a second block is arranged so that the first face is substantially horizontal and the second opening is accessible from an exterior surface of the assembly so as to form a first insertion region for a predetermined portion of the at least one lumber component; and wherein the first insertion region has dimensions that correspond to dimensions of the predetermined portion to create a snug fit between the first insertion region and the predetermined portion;

wherein the three-dimensional cutout region further comprises a tapered end region adjacent the first insertion region, wherein the tapered end region has dimensions smaller than the predetermined portion to prevent insertion of the predetermined portion into the tapered end region.

11. The assembly of claim 10, wherein the second block is arranged so that the first opening is facing downward.

12. The assembly of claim 11, wherein the first block is arranged so that the second opening is also accessible from the exterior surface of the assembly so as to form a second insertion region for a predetermined portion of a second lumber component.

13. An assembly of at least two concrete masonry unit blocks and at least one lumber component, wherein each block comprises a first face and an adjacent second face, wherein the first face and the second face share a common edge; and a three-dimensional cutout region in each block formed by a first opening in a portion of the first face in open communication with a second opening in a portion of the second face;

wherein a first block is arranged so that the first face is substantially horizontal and the second opening is accessible from an exterior surface of the assembly so as to form an insertion region for a predetermined portion of the at least one lumber component;

wherein the insertion region has dimensions that correspond to dimensions of the predetermined portion to create a snug fit between the insertion region and the predetermined portion;

wherein the three-dimensional cutout region further comprises a tapered end region adjacent the insertion region, wherein the tapered end region has dimensions smaller than the predetermined portion to prevent insertion of the predetermined portion into the tapered end region; and wherein a second block is arranged so that the first opening and the second opening of the second block are not accessible from the exterior surface of the assembly.

14. The assembly of claim 13, wherein each block is tapered with the second face not parallel to an opposing face of the block.

15. The assembly of claim 14, wherein at least the first face is in the shape of a trapezoid.

* * * * *